United States Patent [19]

Burton

[11] 4,096,702

[45] Jun. 27, 1978

[54] MINE STOPPING DEVICE AND METHOD OF CONSTRUCTING SAME

[76] Inventor: Willard J. Burton, Box 20, Verdunville, W. Va. 25649

[21] Appl. No.: 623,457

[22] Filed: Oct. 17, 1975

[51] Int. Cl.[2] ..... E21F 1/14

[52] U.S. Cl. ..... 61/45 R; 52/98; 98/50; 49/236

[58] Field of Search ..... 61/45 R, 45 D; 98/50; 52/245, 246, 247, 248, 249, 98; 49/236

[56] References Cited

U.S. PATENT DOCUMENTS

| | | | |
|---|---|---|---|
| 497,211 | 5/1893 | Rees | 49/236 |
| 1,243,377 | 10/1917 | Allison et al. | 98/50 |
| 1,575,626 | 3/1926 | Haapanen | 98/50 |
| 1,876,205 | 9/1932 | Crom | 61/45 R |
| 2,373,955 | 4/1945 | Fuller | 16/131 X |
| 2,615,194 | 10/1952 | Kreiner | 16/129 |
| 2,621,725 | 12/1952 | Shacikoski | 299/12 X |
| 3,302,343 | 2/1967 | Bear | 52/98 |
| 3,661,360 | 5/1972 | Windham | 256/DIG. 6 |
| 3,734,467 | 5/1973 | Weeden | 256/DIG. 6 |
| 3,863,554 | 2/1975 | Boyd | 98/50 |
| 3,906,670 | 9/1975 | Burton | 16/129 X |
| 4,023,372 | 5/1977 | Presler et al. | 16/45 R |

*Primary Examiner*—Dennis L. Taylor
*Attorney, Agent, or Firm*—Cushman, Darby & Cushman

[57] ABSTRACT

A mine stopping device and method of constructing same utilizing a plurality of laterally spaced substantially vertically disposed support members extending from the floor to the ceiling of a mine tunnel with a wire mesh screening secured thereto and extending substantially across the entire cross sectional area of the mine tunnel, and a plaster applied to the wire mesh to form a substantially air tight wall in sealing engagement with the walls, floor and ceiling of the mine tunnel. An inspection door can be provided in the mine stopping with an adjustable hinge which permits the door to be realigned with the door frame if the frame is distorted due to shift in the roof of the mine.

5 Claims, 3 Drawing Figures

Fig. 1
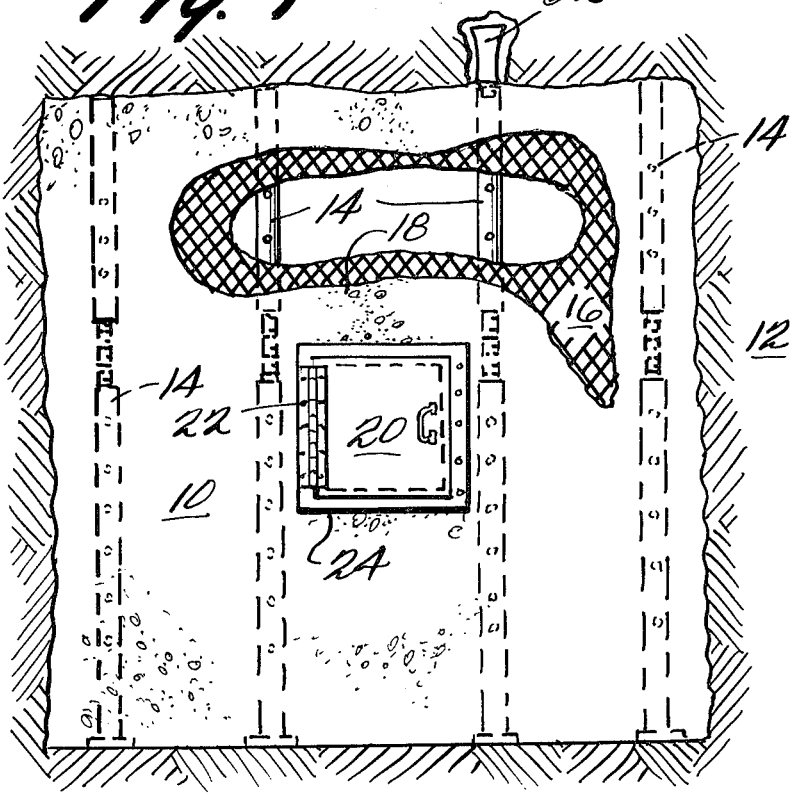
Fig. 2
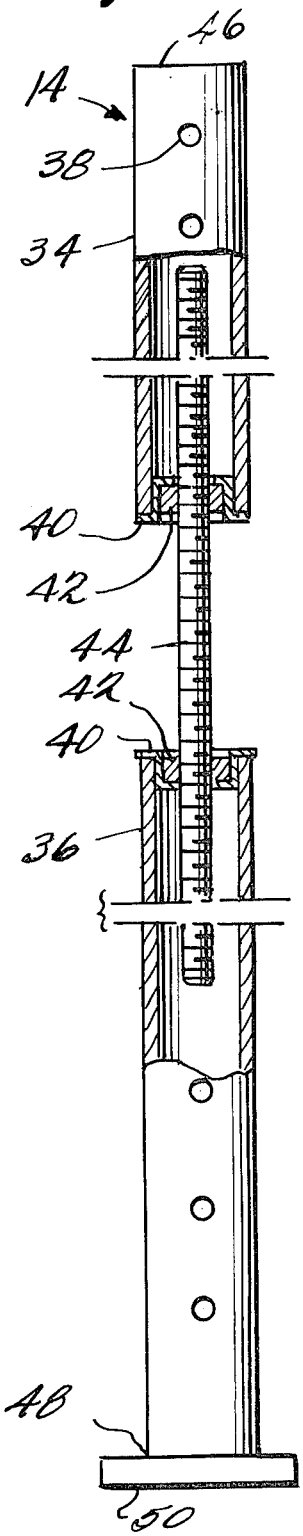
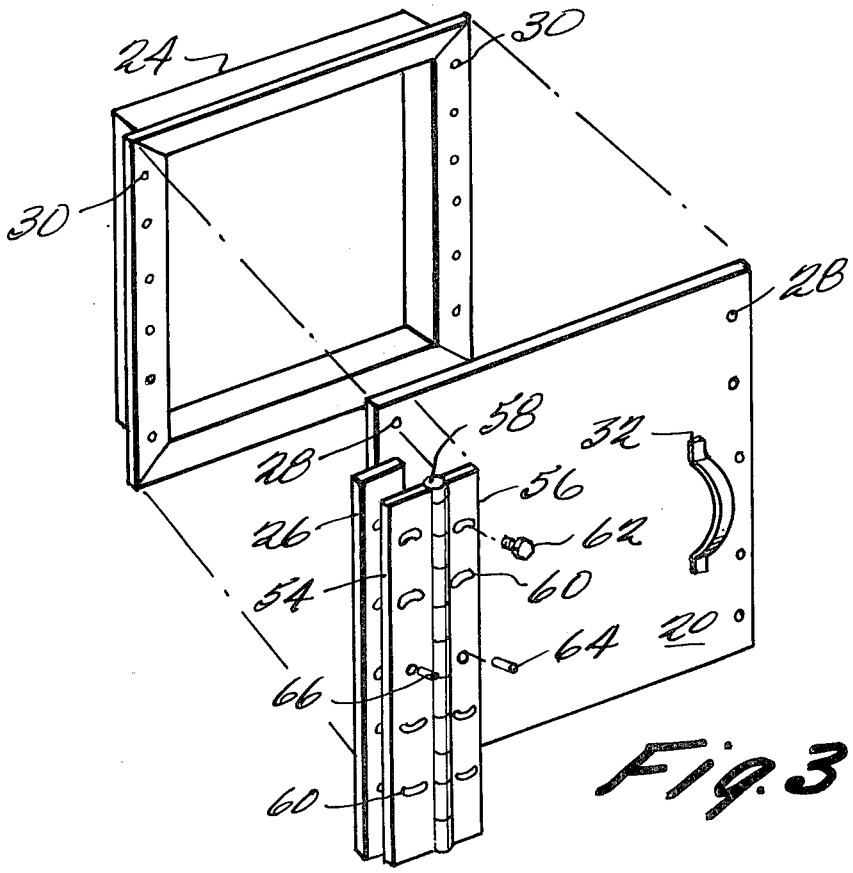
Fig. 3

MINE STOPPING DEVICE AND METHOD OF CONSTRUCTING SAME

BACKGROUND OF THE INVENTION

1. Field of the Invention

This invention relates to mine stopping devices utilized in coal mines or the like, to assist in controlling ventilation through the mine.

2. Prior Art

Mine stopping devices are commonly utilized to control the direction of air flow through mines, particularly in coal mines, where they are often installed in cross cuts at the junction with entries so as to direct air flow to the working face and prevent disturbance or loss of air flow through cross cuts and entries which are not being worked. Such mine stoppings are usually constructed of cinder block which are cemented in place so as to shut off air flow where desired. Commonly, 120 such cinder blocks are required in most coal mine tunnels and this usually requires at least one complete mining car to transport the materials to erect one mine stopping. A substantial amount of time and manpower is also required to construct such a mine stopping since each of the 120 blocks have to be individually set in place and cemented.

When a mine stopping of this type is "blown out" due to a shift in the mine top, this creates difficulties in that an entirely new wall must be constructed, again requiring substantial time and labor that could be utilized usefully elsewhere.

There is a further legal requirement in some coal mines in particular, which requires that every fifth permanent stopping must have an inspection door which can be used as an escapeway for miners in the event of smoke or gas being encountered at the working face. Doors commonly used for this purpose are usually installed within a frame which, when the roof of a mine shifts, are distorted so that the doors are no longer functional and cannot be opened.

SUMMARY OF THE INVENTION

The present invention overcomes the above described disadvantages and difficulties associated with prior art devices by providing a mine stopping device which can be quickly and easily installed in a mine tunnel with substantially reduced time and labor requirements and which can be easily patched if the roof of the mine shifts. In addition, an inspection door is provided which will not become bound and inoperative when the roof shifts.

The above features are accomplished by providing a plurality of adjustable support members which are extendable between the floor and ceiling of a mine tunnel; a wire mesh lathing is then attached to the support members and extends across the entire cross section of the tunnel; and cement or plaster is then spread over the wire mesh and spread in contact with the walls, floor and ceiling of the tunnel so as to produce an air tight wall when the plaster dries. Also, an inspection door is provided which utilizes a frame set into the plaster with a door abutting the outside edge of the frame and an adjustable hinge supported on a spacer and attached to the door frame so as to permit the door to be properly aligned with the frame and be adjusted if the frame is distorted due to movement of the mine roof at the point where the stopping is installed.

By utilizing the above construction, the disadvantages of the prior art mine stopping devices are overcome since such a mine stopping can be easily patched if it is broken or distorted due to the shifting of the mine roof and the door need not be replaced since the adjustable hinge permits the door to be repositioned over the opening even if the frame is distorted.

BRIEF DESCRIPTION OF THE DRAWINGS

FIG. 1 illustrates a preferred embodiment of the present invention in partial cross section, erected in a mine tunnel;

FIG. 2 is an enlarged view in partial cross section of a support member of the preferred embodiment illustrated in FIG. 1; and FIG. 3 is an expanded pictorial view of the door, door frame, spacer member and adjustable hinge utilized to secure the door to the door frame, in the preferred embodiment illustrated in FIG. 1.

DETAILED DESCRIPTION OF THE PREFERRED EMBODIMENT

The mine stopping device 10 is shown erected in a cross section of a coal mine tunnel 12, in FIG. 1. The support members 14 are adjusted so as to be supported between the floor and ceiling of the tunnel. A wire mesh or screening 16 is then secured to the support members 14 and extends across substantially the entire cross sectional area of the tunnel at the point where the device is to be installed. The concrete or plaster 18 is then applied to the wire mesh 16 and is applied in contact with the walls, floor and ceiling of the tunnel to produce an air tight seal when the plaster dries.

The inspection door 20 is supported by adjustable hinge 22 secured to the door frame 24 with a spacer member 26 interposed between the frame and the hinge so as to permit the door to lie flat across the outside edge of the frame 24. Holes 28 can be provided in both sides of the door and holes 30 can be provided in both sides of the frame 24 so that the door can be supported from either the right or left side, as desired. A handle 32 is preferably provided to assist in opening and closing the inspection door.

The support members, best illustrated in FIG. 2, are preferably constructed of a galvanized pipe with upper and lower portions 34 and 36, respectively. Holes 38 are provided along the length of the upper and lower portions 34 and 36 to permit the wire mesh 16 to be secured to the support members by means of screws inserted in holes 38 or wire passed therethrough. Flange washers 40 are provided in the adjacent end portions of members 34 and 36 which grippingly engage hexnuts 42 to maintain them in a stationary position. Stud bolt 44 is threaded through both hexnuts 42 to provide adjustment of the length of support member 14.

The upper end 46 of support member 14 is preferably open for reasons described below, but can be capped or rounded as desired. The bottom end 48 of support members 14 is preferably secured to a base plate 50 to provide additional stability for the support members.

During the mining operation, if it is known in advance a permanent mine stopping is desired, conventional roof bolts 52 may be installed at that point to provide desirable additional support to the roof portion of the tunnel. The support members 14 can then be aligned with the roof bolts, as illustrated in FIG. 1, by placing the open upper end 46 of the support member in alignment with the head of the roof bolt so as to encompass the head of the roof bolt. A support member can thus be aligned with each roof bolt and additional support members may also be utilized if desired, which are not aligned with roof bolts.

The inspection door 20 and frame 24 are preferably positioned in the mine stopping when it is initially being constructed so that the wire mesh 16 can be precut to provide the opening through the mine stopping and the plaster 18 can be applied around the frame 24 to provide support for and seal around the frame. If desired, however, the door may be installed after the permanent mine stopping has been completely installed and the plaster 18 hardens, by merely cutting through the plaster and wire mesh with the appropriate dimensions to permit the frame to be inserted in the mine stopping. Conventional means may then be utilized to secure the frame to the mine stopping, such as for example, using additional plaster to perfect a seal between the frame and the existing plaster.

The dimensions of the opening in the frame are preferably 32 inches by 32 inches to permit a person to crawl through the inspection door and use it as an escape route should an explosion occur at the working face of the mine. The frame can easily be constructed of ¼ inch angle iron and the door and shim of ¼ inch thick steel plate.

The hinge 22 is preferably constructed in accordance with the teachings of my U.S. Pat. No. 3,906,670, the teachings of which are incorporated herein by reference thereto. Essentially, the hinge consists of two portions 54 and 56 joined by a hinge pin 58 in a conventional manner. Portions 54 and 56 have a plurality of radially curved slots 60 through which bolts 62 can pass for securing the hinge to the door and the door frame. The hinge 22 is pivotal relative to the door and door frame by means of pins 64 and 66, respectively. This permits adjustment of the position of the door relative to the door frame prior to securing the hinge thereto by means of bolt 62. Pins 64 and 66 are aligned with corresponding holes in the spacer, frame and door to provide the pivotal support necessary. Utilization of this unique hinge permits the door to be realigned with the opening in the frame member if for any reason the frame should be distorted due, for example, to a shifting in the roof of the mine at the point where the permanent mine stopping is installed.

A further advantage of the utilization of the present door over conventional doors is that conventional doors, which are set within a frame, utilize a spring to close them. By slightly canting or inclining the mine stopping, the door of my invention will close due to gravity and seal properly against the door frame. Of course, if desired a spring (not shown) could be utilized in the conventional manner to close my door.

Although the foregoing description illustrates the preferred embodiment of the present invention, it will be apparent to those skilled in the art that variations are possible. All such variations as would be obvious to those skilled in this art are intended to be included within the scope of this invention.

What is claimed is:

1. A permanent mine stopping device for use in an underground coal mine tunnel or the like, comprising:

a plurality of individual self-supporting vertically disposed support members each being laterally spaced from adjacent members said plurality of support members being positioned so as to extend across the width of the mine tunnel being stopped;

each of said support members having a top and bottom end and adjustment means for vertically adjusting the length of said support member so that the length of each of said support members can be extended until the top and bottom ends respectively come into engagement with the roof and floor of the mine tunnel being stopped so that said support members provide support for the roof of the tunnel;

wire mesh secured to the individual support members and extending over substantially the entire cross-section of the tunnel;

plaster applied to the wire mesh and having its outer periphery in substantially air-tight sealing engagement with the walls, floor and ceiling of the mine tunnel, whereby air is prevented from flowing through the tunnel in which the device is placed, each of said support members being comprised of upper and lower members, said upper and lower members being connected together by said adjustment means so as to be movable toward and away from each other, and wherein each of said upper and lower members are provided along their length with a plurality of apertures so as to permit the wire mesh to be secured to said support members.

2. A device as defined in claim 1 and further including:

door frame means disposed between two adjacent support members, secured to and supported by the plaster so as to provide an opening through the device;

spacer means secured to one side of the door frame means;

adjustable hinge means superposed on the spacer means and secured to the door frame means;

a door secured to the hinge means for pivotal movement about a substantially vertical axis so as to cover the opening in the device to prevent substantial air flow therethrough.

3. A device as defined in claim 2 wherein the adjustable hinge means has a first portion attached to a vertical edge portion of the door for relative pivotal movement in a plane parallel to the door and fixable in a plurality of positions within the pivotal movement so as to permit the door to be aligned with the door frame means, a second portion of the hinge means attached to a vertical edge portion of the door frame means so as to permit a relative pivotal movement of the door in a plane parallel thereto and is fixable in a desired position within the pivotal movement for suspendably securing the door to the door frame means for swinging movement relative thereto to permit opening and closure of the door.

4. A device as defined in claim 2 wherein the door is canted with respect to a vertical plane so as to cause the door to be biased by gravity against the door frame means, covering the opening therein.

5. A mine stopping device as in claim 1 wherein said upper member is provided with an open upper end so as to allow the upper end to encompass the head of a roof bolt.

* * * * *